US007566206B2

(12) United States Patent
Lee et al.

(10) Patent No.: US 7,566,206 B2
(45) Date of Patent: Jul. 28, 2009

(54) LINEAR COMPRESSOR FOR MULTI-STAGE COMPRESSION

(75) Inventors: Jong Koo Lee, Suwon (KR); Gye Young Song, Kwangmyung (KR)

(73) Assignee: LG Electronics Inc., Seoul (KR)

( * ) Notice: Subject to any disclaimer, the term of this patent is extended or adjusted under 35 U.S.C. 154(b) by 758 days.

(21) Appl. No.: 10/857,889

(22) Filed: Jun. 2, 2004

(65) Prior Publication Data

US 2004/0247466 A1 Dec. 9, 2004

(30) Foreign Application Priority Data

Jun. 4, 2003 (KR) ..... 10-2003-0035930

(51) Int. Cl.
*F04B 23/06* (2006.01)
*F04B 17/04* (2006.01)
*F04B 53/00* (2006.01)

(52) U.S. Cl. ..... 417/258; 417/53; 417/260; 417/262; 417/417; 417/523

(58) Field of Classification Search ..... 417/417, 417/418, 523, 555.1, 53, 258, 260, 262
See application file for complete search history.

(56) References Cited

U.S. PATENT DOCUMENTS 2,880,927 A * 4/1959 Ploegert ..... 417/258
4,455,497 A * 6/1984 Shtrikman ..... 310/30
4,496,287 A * 1/1985 Nelson et al. ..... 417/63
6,015,270 A * 1/2000 Roth ..... 417/259
7,165,951 B2 * 1/2007 Magami et al. ..... 417/396
2004/0247457 A1 12/2004 Kim et al.

FOREIGN PATENT DOCUMENTS

KR 10-2001 0026724 4/2001

OTHER PUBLICATIONS

English Language Abstract Korea 10-2001-0026724.

* cited by examiner

*Primary Examiner*—Charles G Freay
(74) *Attorney, Agent, or Firm*—Birch, Stewart, Kolasch & Birch, LLP

(57) ABSTRACT

A linear compressor for multi-compression includes a stationary cylinder, a moving piston, and a stationary piston. The stationary cylinder has a first compression chamber formed therein. The stationary cylinder is provided at one side thereof with an outlet part. The moving piston is movable forward and backward by a linear motor, that compresses a fluid in the first compression chamber. The moving piston has a second compression chamber formed and is provided, at the position where the second compression chamber communicates with the first compression chamber, with a first valve. The stationary piston is fixedly disposed in the compressor. The stationary piston is fitted in the moving piston so that the fluid in the second compression chamber is compressed as the moving piston is reciprocated.

23 Claims, 6 Drawing Sheets

LINEAR COMPRESSOR FOR MULTI-STAGE COMPRESSION

RELATED APPLICATIONS

The present disclosure relates to subject matter contained in Korean Application No. 2003-35930, filed on Jun. 4, 2003, which is herein expressly incorporated in its entirety.

BACKGROUND OF THE INVENTION

1. Field of the Invention

The present invention relates to a linear compressor, and more particularly to a linear compressor that is capable of successively compressing a fluid with a plurality of compression chambers before the fluid is discharged.

2. Description of the Related Art

Generally, a linear compressor is constructed such that a linear driving force from a linear motor is transmitted to a piston, which is linearly reciprocated in a cylinder, whereby a fluid, such as coolant gas, is introduced, compressed, and discharged.

FIG. 1 is a longitudinal sectional view showing a conventional linear compressor.

As shown in FIG. 1, the conventional linear compressor includes an inner case 10 mounted inside a hermetically sealed container 1. The inner case 10 is formed in the shape of a cylinder having a prescribed length. To one side of the inner case 10 is fixed a back cover 20 having a fluid inlet channel 18 formed therein.

Inside the inner case 10 is mounted a linear motor 30 for generating a driving force. To the linear motor 30 is connected a piston 40 having a fluid flow channel 38 formed therein. To the piston is attached an inlet valve 50 for opening and closing the fluid flow channel 38. To the other side of the inner case 10 is fixed a cylinder block 60 having a cylinder 58, in which the piston 40 is movably fitted such that the piston 40 can be moved forward and backward in the cylinder 58.

To the cylinder block 60 is attached an outlet valve 70 for opening the cylinder 58 so that the compressed fluid is discharged and for closing the cylinder 58 so that the compressed fluid is not discharged. The outlet valve 70 defines a compression chamber C together with the cylinder 58 and the piston 40.

To the hermetically sealed container 1 is connected an inlet connection pipe 2, through which a fluid is introduced into the hermetically sealed container 1 from the outside, in such a manner that the inlet connection pipe 2 is disposed in front of the fluid inlet channel 18 of the back cover 20.

The inlet valve 50 is formed in the shape of a plate. One side of the plate is fixed to the piston 40, and the plate is elastically bent for opening and closing the fluid flow channel 38 of the piston 40.

The outlet valve 70 comprises: an outlet cover 72 mounted to the cylinder block 60 and connected to an outlet pipe at one side thereof; and a valve body 76 supported by a spring 74 disposed in the outlet cover 72 for opening and closing the cylinder.

The operation of the conventional linear compressor with the above-stated construction will now be described.

When electric current is supplied to the linear motor 30, the linear motor 30 is operated so that the piston 40 is linearly reciprocated in the cylinder 58. As the piston 40 is linearly reciprocated in the cylinder 58, the outlet valve 70 and the inlet valve 50 are opened and closed.

At this time, the fluid is introduced into the hermetically sealed container 1 through the inlet pipe 2. Subsequently, the fluid is guided into the compression chamber C through the fluid inlet channel 18 of the back cover 20 and the fluid flow channel 38 of the piston 40. The fluid introduced into the compression chamber C is compressed by the linear reciprocating movement of the piston 40. The compressed high-temperature and high-pressure gaseous fluid is discharged out of the hermetically sealed container 1 through the outlet valve 70 and the outlet pipe.

However, the above-mentioned conventional linear compressor has only a single compression chamber disposed in the cylinder block with the result that the fluid introduced into the compressor is compressed only once in the compression chamber C formed between the piston 40 and the outlet valve 70, and is then discharged. Consequently, the conventional linear compressor has problems in that compression efficiency of the linear compressor is very low, and performance of the linear compressor is limited.

SUMMARY OF THE INVENTION

Therefore, the present invention has been made in view of the above problems, and it is an object of the present invention to provide a linear compressor that is capable of successively compressing a fluid in a multi-stage fashion before the fluid is discharged, whereby compression efficiency of the linear compressor is increased, and the overall dimensions of the linear compressor are reduced.

In accordance with one aspect of the present invention, the above and other objects can be accomplished by the provision of a linear compressor comprising: a stationary cylinder having a first compression chamber formed therein, the stationary cylinder being provided at one side thereof with an outlet part; a moving piston movable forward and backward by a linear motor that compresses a fluid in the first compression chamber, the moving piston having a second compression chamber formed therein, the moving piston being provided, at the position where the second compression chamber communicates with the first compression chamber, with a first valve; and a stationary piston fixedly disposed in the compressor, the stationary piston being fitted in the moving piston so that the fluid in the second compression chamber is compressed as the moving piston is reciprocated, the stationary piston having an inlet flow channel formed therein so that the fluid is introduced through the inlet flow channel, the stationary piston being provided, at the position where the inlet flow channel communicates with the second compression chamber, with a second valve.

Preferably, the stationary cylinder is provided at the front part thereof with an outlet valve, the outlet valve being opened when the pressure in the first compression chamber is more than a prescribed pressure.

Preferably, the moving piston comprises: a piston part movable linearly, a part of the piston part being inserted in the stationary cylinder; and a moving cylinder part connected to the rear of the piston part, the moving cylinder part being inserted in the stationary piston.

Preferably, the piston part is provided at the rear thereof with a flange, the flange being fixed to a mover of the linear motor, and the moving cylinder part is fixedly attached to the rear of the flange.

Preferably, the first valve is opened when the moving piston is moved backward toward the stationary piston, and the second valve is opened when the moving piston is moved forward toward the stationary cylinder.

Preferably, the first and second valves are plate valves provided at the front ends of the moving piston and the stationary piston, respectively. Preferably, the compressor further comprises a valve-actuating unit that opens and closes the second valve.

Preferably, the second valve is a plate valve provided at the front part of the stationary piston, and the valve-actuating unit comprises: an actuator that generates a driving force on the basis of an external signal; and a push rod that connects the actuator and the plate valve that moves the plate valve according to the operation of the actuator.

In accordance with another aspect of the present invention, there is provided a linear compressor comprising: a first cylinder; an outlet valve disposed at the front part of the first cylinder; a first piston connected to a linear motor, the first piston being movable forward and backward in the first cylinder, the first piston having a first flow channel formed therein, the first flow channel communicating with the interior of the first cylinder; a first inlet valve disposed at the front part of the first piston, that opens and closes the first flow channel; a second cylinder connected to the rear part of the first piston so that the second cylinder is moved along with the first piston, the second cylinder having a second flow channel formed therein, the second flow channel communicating with the first flow channel; a back cover disposed in the compressor, the back cover having an inlet port formed therein; a second piston fixedly attached to the back cover, the second piston being fitted in the second cylinder such that fluid in the first and second flow channels is compressed as the first piston and the second cylinder are reciprocated, the second piston having a third flow channel formed therein, the inlet port of the back cover being connected to the second flow channel via the third flow channel; and a second inlet valve disposed at the front part of the second piston that opens and closes the third flow channel.

In the linear compressor with the above-stated construction according to the present invention, the compression chambers for compressing the fluid are arranged such that the compression chambers communicate with each other. The coolant is first compressed in one of the compression chambers, and is then compressed in the other compression chamber. Consequently, compression efficiency of the fluid is high.

Also, the linear compressor according to the present invention includes the valve-actuating unit for forcibly opening one of the compression chambers. Consequently, compression capacity of the linear compressor is variable by the valve-actuating unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

It should be understood that linear compressors according to numerous preferred embodiments of the present invention may be proposed, although only the most preferred embodiments of the present invention will be hereinafter described.

Figure 1:
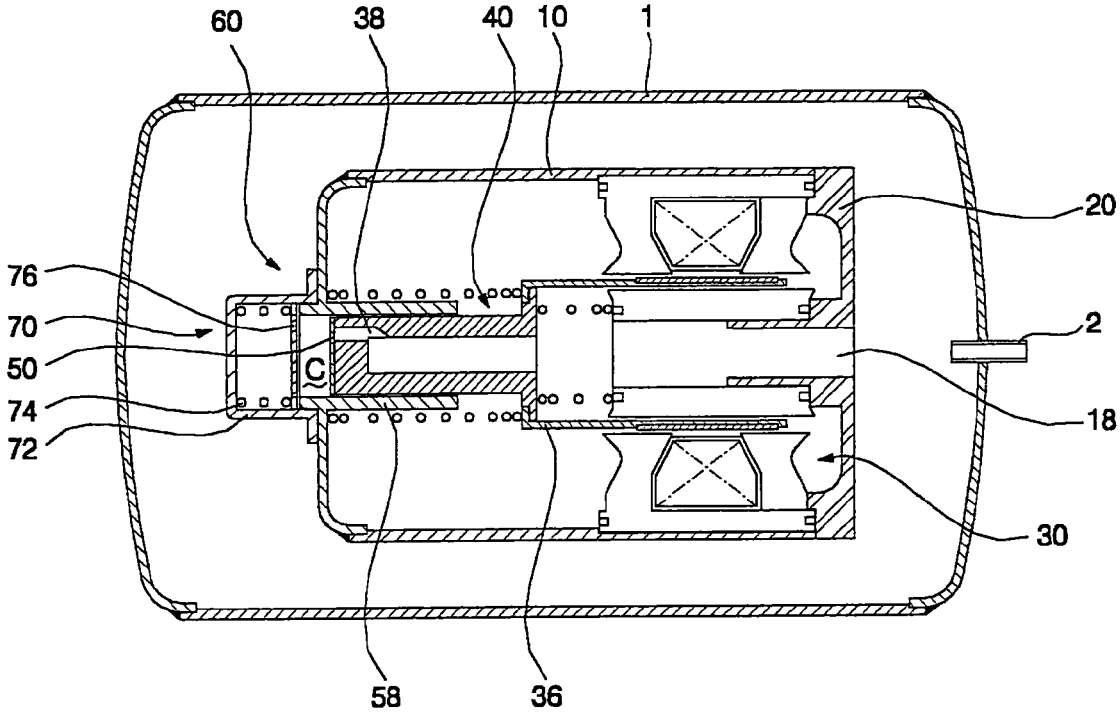
FIG. 1 (Prior Art)
FIG. 1 is a longitudinal sectional view showing a conventional linear compressor.
Figure 2:
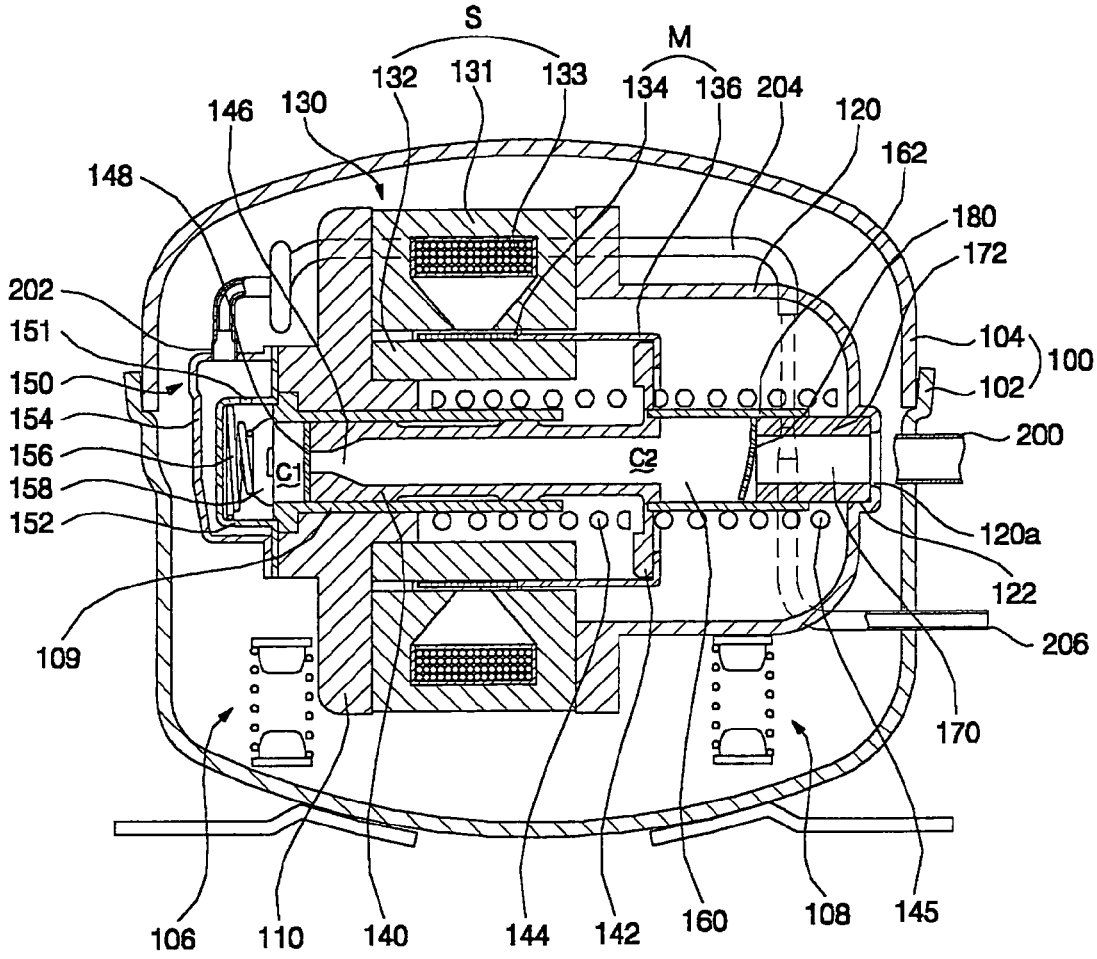
FIG. 2 is a longitudinal sectional view showing a linear compressor according to a first preferred embodiment of the present invention.

FIG. 2 is a longitudinal sectional view showing the interior of a linear compressor according to a first preferred embodiment of the present invention.

As shown in FIG. 2, the linear compressor according to the present invention includes a hermetically sealed container 100. The hermetically sealed container 100 includes: a lower container 102, the upper part of which is opened; and an upper cover 104 for covering the opened upper part of the lower container 102.

In the hermetically sealed container 100 is disposed a cylinder block 110 having a first cylinder 109 formed therein in such a manner that the cylinder block 110 is placed on a first damper 106 mounted to one side of the lower container 102 while shock applied to the cylinder block 110 is absorbed by the first damper 106. In the hermetically sealed container 100 is also disposed a back cover 120 having an inlet port 120*a* formed therein, through which a fluid is introduced, in such a manner that the back cover 120 is placed on a second damper 108 mounted to the other side of the lower container 102 while shock applied to the back cover 120 is absorbed by the second damper 108.

Between the cylinder block 110 and the back cover 120 is disposed a linear motor 130 for generating a driving force, which is required to compress the fluid. To the linear motor 130 is connected a first piston 140 for delivering the fluid into the first cylinder 109 and compressing the fluid in the first cylinder 109 while being reciprocated in the first cylinder 109.

The linear motor 130 includes a stator S and a mover M. The stator S includes: an outer laminated core 131; an inner laminated core 132 disposed such that the inner core 132 is spaced apart from the outer core 131 by a prescribed gap distance; and a coil 133 wound on the outer core 131. The mover M includes: a magnet 134 moving forward/backward by a magnetic force generated around the coil 133; and a magnet frame 136 disposed between the outer core 131 and the inner core 132 such that the magnet frame 136 moves forward/backward. The magnet 134 is fixed to the magnet frame 136. The magnet frame 136 is attached to the first piston 140.

The outer core 131 is disposed between the cylinder block 110 and the back cover 120 while the outer core 131 is fixed to the cylinder block 110 and the back cover 120 by suitable fastening members. The inner core 132 is fixed to the cylinder block 110 by suitable fastening members. The magnet frame 136 is fixed to the first piston 140 by suitable fastening members.

A portion of the first piston 140 is fitted in the first cylinder 109 while being reciprocated in the first cylinder 109 so that the first piston 140 moves forward and backward in the first cylinder 109. At the end of the other portion of the first piston 140 is formed a flange 142, which is extended in the radial direction. The flange 142 is fixed to the magnet frame 136 by suitable fastening members.

The first piston 140 is elastically supported by a first spring 144 disposed between one surface of the flange 142 and the cylinder block 110 and a second spring 145 disposed between the other surface of the flange 142 and the back cover 120 so that the first piston 140 is reciprocated along with the mover M of the linear motor 130.

The first piston 140 has a first flow channel 146 longitudinally formed therethrough. The first flow channel 146 communicates with the interior of the first cylinder 109 so that the fluid is introduced into the first cylinder 109 by the first piston 140.

Preferably, the first inlet valve 148 may be a plate valve wherein one side of the plate valve is fixed to the front end of the piston 140, and the part of the plate valve corresponding to the fluid flow channel 146 of the piston 140 is elastically bent so that the port of the fluid flow channel 146 of the piston 140 is opened or closed.

Consequently, when the first piston 140 is moved backward toward the back cover 120, the part of the first inlet valve 148 corresponding to the fluid flow channel 146 of the piston 140 is bent in the direction opposite to the back cover 120 by the fluid existing in the fluid flow channel 146, whereby the fluid flow channel 146 is opened. On the other hand, when the first piston 140 is moved forward toward an outlet valve 150, the part of the first inlet valve 148 corresponding to the fluid flow channel 146 of the piston 140 is straightened in the direction opposite to the outlet valve 150 by the fluid existing in the first cylinder 109 and by its own elastic force, whereby the fluid flow channel 146 is closed.

The outlet valve 150 disposed in the linear compressor is provided to open/close the first cylinder 109. The outlet valve 150 defines a first compression chamber C1 together with the first cylinder 109 and the first piston 140.

The outlet valve 150 includes: an inner outlet cover 152 mounted to the cylinder block 110 while communicating with the first cylinder 109 and having a fluid outlet hole 151 formed at one side thereof; an outer outlet cover 154 disposed outside the inner outlet cover 152 while being spaced apart from the inner outlet cover 152; and a valve body 158 elastically supported by a spring 156 disposed in the inner outlet cover 152 for opening and closing the first cylinder 109.

Consequently, when the pressure of the fluid in the first compression chamber C1 is larger than the elastic force of the spring 156, the valve body 158 is pushed by the fluid so that the first cylinder 109 is opened. On the other hand, when the pressure of the fluid in the first compression chamber C1 is smaller than the elastic force of the spring 156, the valve body 158 is pushed by the spring 156 so that the first cylinder 109 is closed.

The linear compressor further includes: a second cylinder 162 attached to the first piston 140 such that the second cylinder 162 is reciprocated along with the first piston 140, the second cylinder 162 having a second flow channel 160 longitudinally formed therethrough such that the second flow channel 160 communicates with the first flow channel 146; and a second piston 172 attached to the back cover 120 for delivering a fluid into the second flow channel 160 of the second cylinder and compressing the fluid existing in the first flow channel 146 and the second flow channel 160 as the second cylinder 162 is moved forward. The second flow channel 160 defines a second compression chamber C2 together with the first flow channel 146.

The second cylinder 162 is formed in the shape of a hollow cylinder having the second flow channel 160 formed therein. One end of the second cylinder 162 is fixedly attached to the flange 142 of the first piston 140 so that the second cylinder 162 is disposed in the direction of the forward/backward movement of the first piston 140 opposite to the first inlet valve 148.

One end of the second piston 172 is fixed to the back cover 120. The outer diameter of the second piston 172 is smaller than the inner diameter of the second cylinder 162 so that the second piston 172 is reciprocated in the second cylinder 162 when the second cylinder 162 is moved forward and backward.

Also, the second piston 172 is formed in the shape of a hollow cylinder having a third flow channel 170 longitudinally formed therethrough. The third flow channel 170 communicates with the inlet port 120*a* and the second flow channel 160. The second piston 172 is provided with a second inlet valve 180 for opening and closing the third flow channel 170.

Preferably, the second inlet valve 180 may be a plate valve wherein one side of the plate valve is fixed to the second cylinder 172, and the part of the plate valve corresponding to the third flow channel 170 of the second cylinder 172 is elastically bent.

Consequently, when the first piston 140 and the second cylinder 162 are moved forward toward the outlet valve 150, the part of the second inlet valve 180 corresponding to the third flow channel 170 is bent toward the outlet valve 150 due to pressure difference between the first and second flow channels 146 and 160 and the third flow channel 170, whereby the third fluid flow channel 170 is opened. On the other hand, when the first piston 140 and the second cylinder 162 are moved backward toward the inlet port 120*a* of the back cover 120, the second inlet valve 180 closes the third flow channel 170 by the fluid existing in the first flow channel 146 and the second flow channel 160 and by its own elastic force.

Reference numeral 122 indicates an insertion groove 122 formed at the back cover 120 so that one end of the second piston 172 is inserted into the insertion groove 122.

Reference numeral 200 indicates an inlet connection pipe connected to the hermetically sealed container 100 while the inlet connection pipe 200 is penetrated into the hermetically sealed container 100. A fluid is introduced into the hermetically sealed container 100 from the outside through the inlet connection pipe 200. Reference numeral 202 indicates an outlet pipe connected to the outer outlet cover 154 of the outlet valve 150 for allowing the fluid having been introduced through the outlet valve 150 to pass therethrough. Reference numeral 204 indicates a loop pipe having one end connected to the outlet pipe 180, and reference numeral 206 indicates an outlet connection pipe having one end connected to the loop pipe 204. The outlet connection pipe 206 is penetrated through the hermetically sealed container 100 so that the outlet connection pipe 206 is extended to the outside.

The operation of the linear compressor with the above-stated construction according to the present invention will now be described in detail.

When electric current is supplied to the coil 133 of the linear motor 130, there is created a magnetic field around the coil 133, and the magnet 134 is moved forward and backward due to the magnetic field created around the coil 133. The forward/backward movement of the magnet 134 is transmitted to the first piston 140 and the second cylinder 162 via the magnet frame 136. Consequently, the first piston 140 and the second cylinder 162 are linearly reciprocated between the valve body 158 of the outlet valve 150 and the inlet port 120*a* of the back cover 120.

The first piston 140 is moved forward in the first cylinder 109 so that the interior of the first compression chamber C1 is compressed by the first piston 140. The second cylinder 162 is moved backward along the second piston 172 so that the interior of the second compression chamber C2 is compressed by the second piston 172. The first inlet valve 148, the second inlet valve 180, and the outlet valve 150 are opened or closed by the reciprocating movement of the first piston 140 and the second cylinder 162. As a result, the fluid is compressed while successively passing through the second compression chamber C2 and the first compression chamber C1.

Now, a process of compressing the fluid according to the reciprocating movement of the first piston 140 and the second cylinder 162 will be described in detail with reference to FIGS. 3 to 6.

Figure 3:
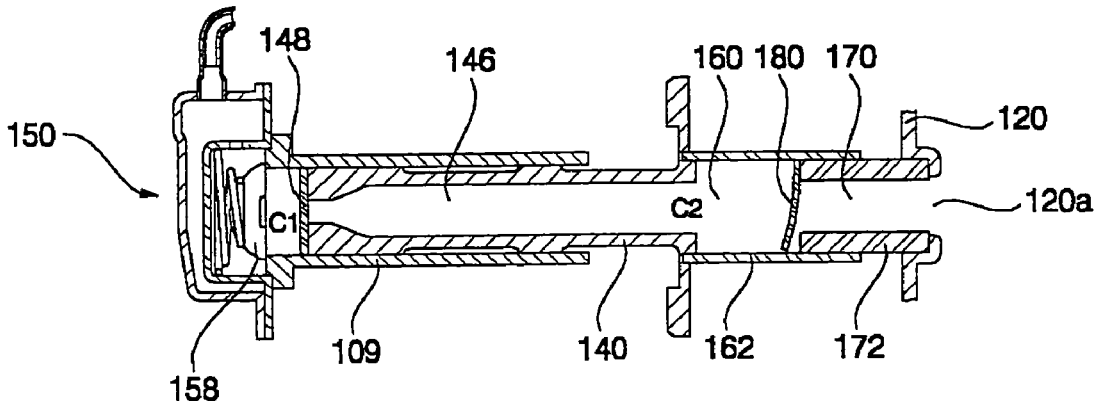
FIG. 3 is a sectional view of the linear compressor according to the first preferred embodiment of the present invention showing main components of the linear compressor when a first piston and a second cylinder begin to move forward.
Figure 4:
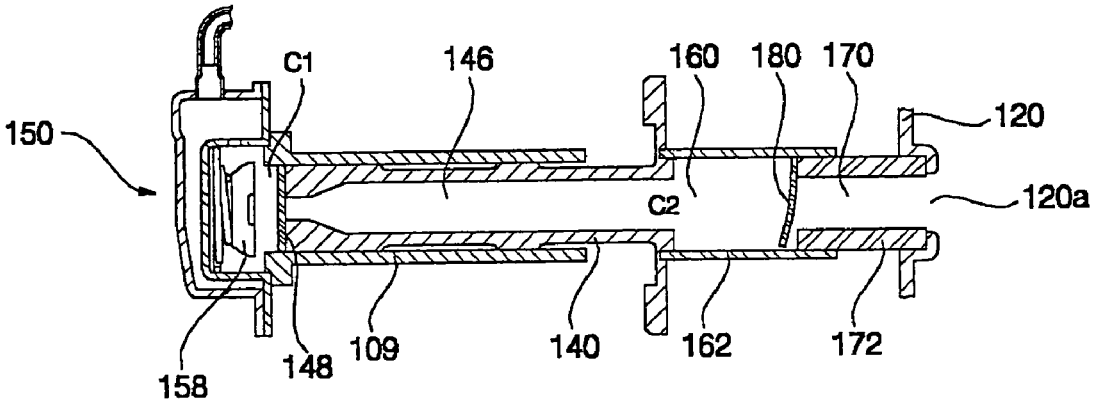
FIG. 4 is a sectional view of the linear compressor according to the first preferred embodiment of the present invention showing the main components of the linear compressor when the forward movement of the first piston and the second cylinder is terminated.

FIG. 3 is a sectional view of the linear compressor according to the first preferred embodiment of the present invention showing main components of the linear compressor when a first piston and a second cylinder begin to move forward, and FIG. 4 is a sectional view of the linear compressor according to the first preferred embodiment of the present invention showing the main components of the linear compressor when the forward movement of the first piston and the second cylinder is terminated.

When the first piston 140 and the second cylinder 162 are moved forward toward the outlet valve 150 as shown in FIGS. 3 and 4, the part of the first inlet valve 148 corresponding to the first flow channel 146 is closed due to pressure difference between the first compression chamber C1 and the second compression chamber C2 or due to its own elastic force. As a result, the fluid existing in the first compression chamber C1 is compressed, and is then discharged through the outlet valve 150. The part of the second inlet valve 180 corresponding to the third flow channel 170 is opened toward the outlet valve 150 due to pressure difference between the second compression chamber C2 and the third flow channel 170. As a result, the fluid existing outside the back cover 120 is introduced into the second compression chamber C2 through the inlet port 120*a* of the back cover 120 and the third flow channel 170 of the third piston 172.

That is, when the first piston 140 and the second cylinder 162 are moved forward, the fluid is compressed in the first compression chamber C1, and is then discharged from the first compression chamber C1 while the fluid is introduced into the second compression chamber C2.

Figure 5:
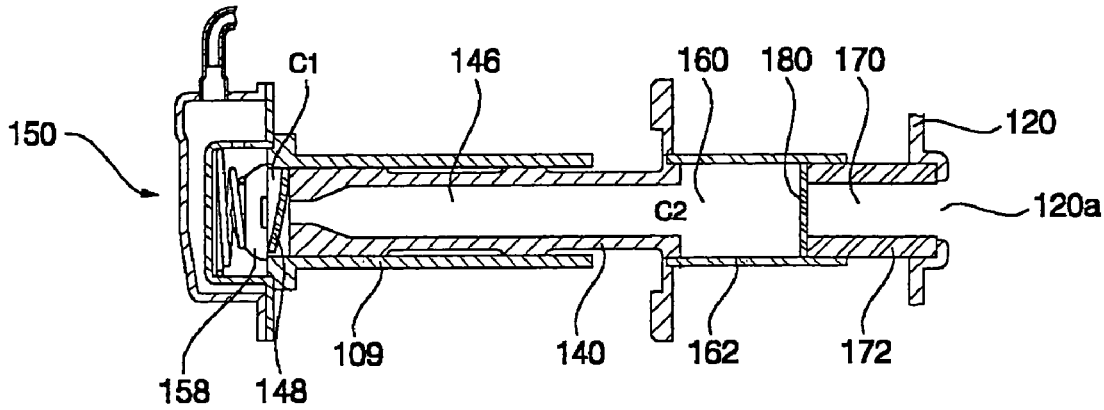
FIG. 5 is a sectional view of the linear compressor according to the first preferred embodiment of the present invention showing the main components of the linear compressor when the first piston and the second cylinder begin to move backward.
Figure 6:
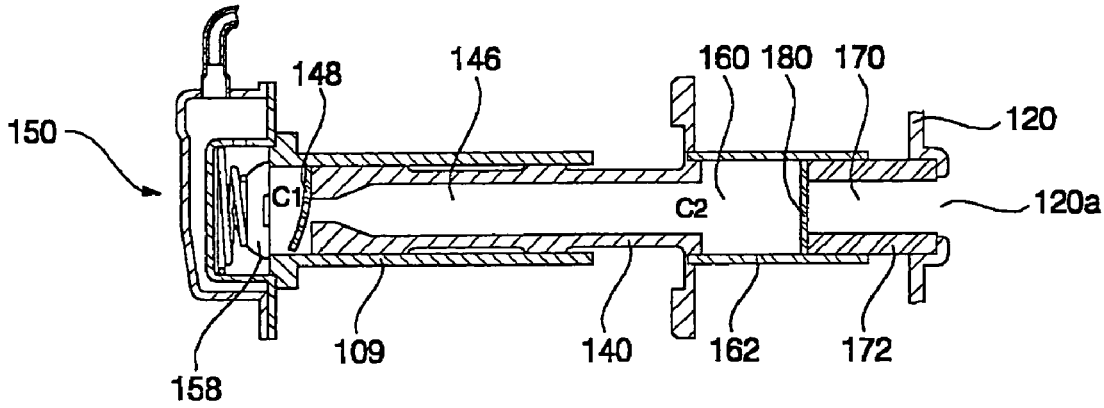
FIG. 6 is a sectional view of the linear compressor according to the first preferred embodiment of the present invention showing the main components of the linear compressor when the backward movement of the first piston and the second cylinder is terminated.

FIG. 5 is a sectional view of the linear compressor according to the first preferred embodiment of the present invention showing the main components of the linear compressor when the first piston and the second cylinder begin to move backward, and FIG. 6 is a sectional view of the linear compressor according to the first preferred embodiment of the present invention showing the main components of the linear compressor when the backward movement of the first piston and the second cylinder is terminated.

When the first piston 140 and the second cylinder 162 are moved backward toward the inlet port 120*a* of the back cover 120 as shown in FIGS. 5 and 6, the fluid existing in the second compression chamber C2 is compressed, and the part of the second inlet valve 180 corresponding to the third flow channel 170 is closed due to pressure difference between the second compression chamber C2 and the third flow channel 170 or due to its own elastic force. The part of the first inlet valve 148 corresponding to the first flow channel 146 is opened toward the outlet valve 150 due to pressure difference between the first compression chamber C1 and the second compression chamber C2. As a result, the fluid compressed in the second compression chamber C2 is introduced into the first compression chamber C1.

That is, when the first piston 140 and the second cylinder 162 are moved backward, the fluid compressed in the second compression chamber C2 is introduced into the first compression chamber C1 while the fluid is compressed in the second compression chamber C2, and is then introduced into the first compression chamber C1.

Figure 7:
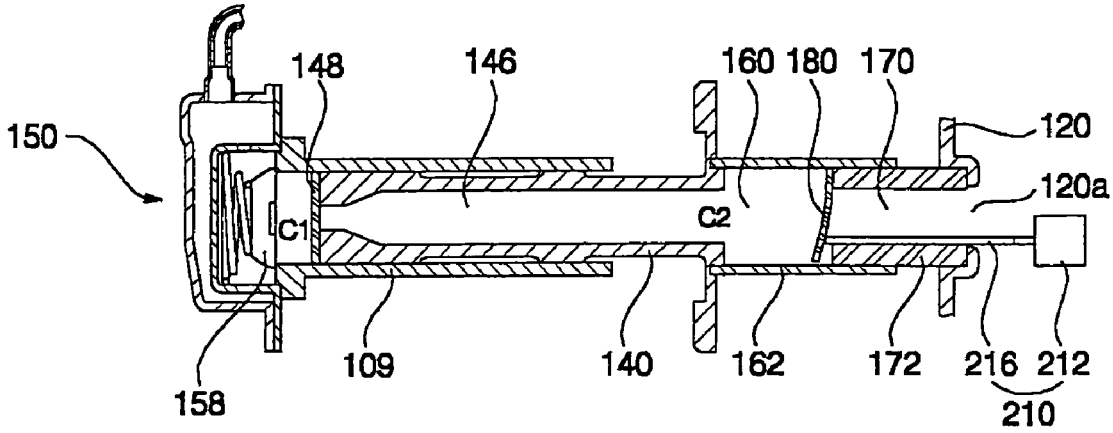
FIG. 7 is a sectional view of a linear compressor according to a second preferred embodiment of the present invention showing main components of the linear compressor when a first piston and a second cylinder begin to move forward.
Figure 8:
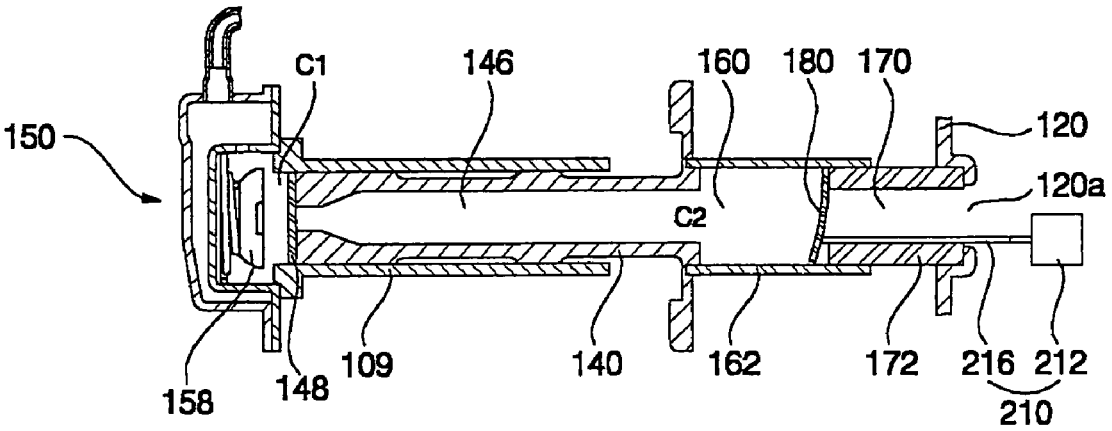
FIG. 8 is a sectional view of the linear compressor according to the second preferred embodiment of the present invention showing the main components of the linear compressor when the forward movement of the first piston and the second cylinder is terminated.
Figure 9:
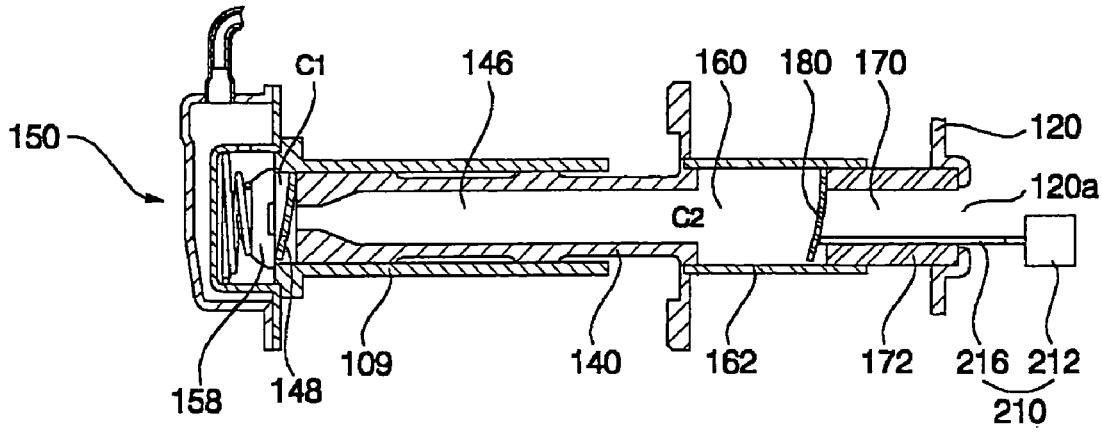
FIG. 9 is a sectional view of the linear compressor according to the second preferred embodiment of the present invention showing the main components of the linear compressor when the first piston and the second cylinder begin to move backward.
Figure 10:
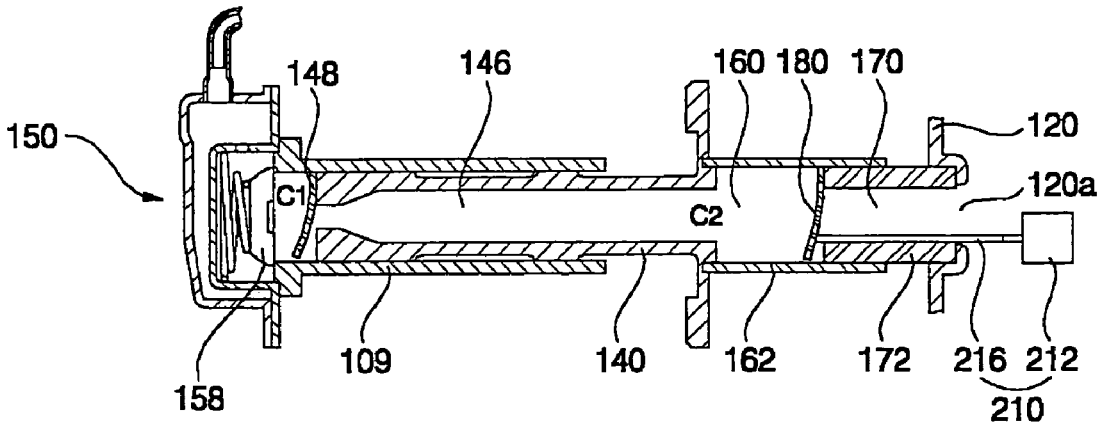
FIG. 10 is a sectional view of the linear compressor according to the second preferred embodiment of the present invention showing the main components of the linear compressor when the backward movement of the first piston and the second cylinder is terminated.

FIG. 7 is a sectional view of a linear compressor according to a second preferred embodiment of the present invention showing main components of the linear compressor when a first piston and a second cylinder begin to move forward, FIG. 8 is a sectional view of the linear compressor according to the second preferred embodiment of the present invention showing the main components of the linear compressor when the forward movement of the first piston and the second cylinder is terminated, FIG. 9 is a sectional view of the linear compressor according to the second preferred embodiment of the present invention showing the main components of the linear compressor when the first piston and the second cylinder begin to move backward, and FIG. 10 is a sectional view of the linear compressor according to the second preferred embodiment of the present invention showing the main components of the linear compressor when the backward movement of the first piston and the second cylinder is terminated.

The linear compressor according to the second preferred embodiment of the present invention is identical to the compressor according to the previously described first preferred embodiment of the present invention in terms of construction and operation except that the linear compressor according to the second preferred embodiment of the present invention further includes a valve-actuating unit 210 for actuating the second inlet valve 180. Therefore, elements of the linear compressor according to the second preferred embodiment of the present invention, which correspond to those of the linear compressor according to the first preferred embodiment of the present invention, are indicated by the same reference numerals as those of the linear compressor according to the first preferred embodiment of the present invention, and a detailed description thereof will not be given.

The valve-actuating unit 210 includes: an actuator 212 mounted to the outside of the back cover 120; and a push rod 216 connected to the actuator 212 and disposed in the third flow channel 170 while being moved forward and backward for pushing the part of the second inlet valve 180 corresponding to the third flow channel 170 toward the outlet valve 150.

Preferably, the actuator 212 may be a common solenoid actuator. Alternatively, the actuator may include a rack and pinion for converting a rotating force from the motor into a rectilinear motion so that the push rod 216 is linearly moved.

In the linear compressor equipped with the valve-actuating unit according to the second preferred embodiment of the present invention, it is possible that the part of the second inlet valve 180 corresponding to the third flow channel 170 remains opened by the push rod 216 with the operation of the actuator 212. In this case, the fluid is introduced into the first compression chamber C1, and is then discharged while not being compressed in the second compression chamber C2. As a result, compression capacity of the linear compressor is low as compared to the compression capacity of the linear compressor when the part of the second inlet valve 180 corresponding to the third flow channel 170 is repeatedly opened and closed.

With the linear compressor according to the second preferred embodiment of the present invention, the compression capacity can be easily adjusted by the valve-actuating unit 210.

As apparent from the above description, the present invention provides a linear compressor having a plurality of compression chambers for compressing a fluid, which are disposed such that the compression chambers communicate with each other, wherein coolant is first compressed in one of the compression chambers, and is then compressed in the other compression chamber before the coolant is discharged, whereby compression efficiency of the fluid is improved.

The linear compressor according to the present invention includes a first cylinder having a first compression chamber formed therein and a second cylinder attached to a first piston, which is movable forward/backward along with a linear motor. In the first piston and the second cylinder is defined a second compression chamber. The linear compressor according to the present invention also includes a second piston, by which the second compression chamber is compressed when the first piston and the second cylinder is moved forward. Consequently, the structure of the linear compressor, in which the plurality of compression chambers are formed, is very simple, and thus the overall dimensions of the linear compressor are minimized.

Furthermore, the linear compressor according to the present invention further comprises a valve-actuating unit for forcibly opening one of the compression chambers, whereby compression capacity of the linear compressor is variable by the valve-actuating unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A linear compressor comprising:

a linear motor comprising a stator and a magnet, said linear motor configured to generate a linear driving force;

a stationary cylinder having a first compression chamber formed therein, an outlet valve being provided at a front portion of the stationary cylinder;

a moving piston movable forward and backward by said linear motor, by the magnet of the linear motor being connected to said moving piston to compress a fluid in the first compression chamber, the moving piston having a second compression chamber therein, a first valve provided at a front portion of the moving piston such that the first compression chamber is provided in the stationary cylinder in a space between the outlet valve and the first valve; and a stationary piston fixedly positioned in the compressor, the stationary piston being fitted in the moving piston so that the fluid in the second compression chamber is compressed as the moving piston is reciprocated, the stationary piston having an inlet flow channel provided therein so that the fluid is introduced through the inlet flow channel; and a second valve provided at the stationary piston such that the second compression chamber is provided between the first valve and the second valve;

wherein the stationary piston is spaced from a rear end of the stationary cylinder in an axial direction of the stationary cylinder, and wherein the moving piston comprises:

a piston part that is linearly movable, a portion of the piston part extending into the stationary cylinder; and a moving cylinder part connected to a rear of the piston part, the stationary piston being positioned within the moving cylinder.

2. The compressor as set forth in claim 1, the outlet valve being opened when the pressure in the first compression chamber is more than a prescribed pressure.

3. The compressor as set forth in claim 1, wherein the piston part is provided at the rear thereof with a flange, the flange being fixed to a moving member of the linear motor, and wherein the moving cylinder part is fixedly attached to the rear of the flange.

4. The compressor as set forth in claim 1, wherein the first valve is opened when the moving piston is moved backward toward the stationary piston.

5. The compressor as set forth in claim 1, wherein the second valve is opened when the moving piston is moved forward toward the stationary cylinder.

6. The compressor as set forth in claim 1, wherein the first and second valves comprise plate valves provided at the front ends of the moving piston and the stationary piston, respectively.

7. A linear compressor comprising:

a linear motor comprising a stator and a magnet, said linear motor configured to generate a linear driving force;

a stationary cylinder having a first compression chamber formed therein, an outlet valve being provided at a front portion of the stationary cylinder;

a moving piston movable forward and backward by said linear motor, by the magnet of the linear motor being connected to said moving piston to compress a fluid in the first compression chamber, the moving piston having a second compression chamber therein, a first valve provided at a front portion of the moving piston such that the first compression chamber is provided in the stationary cylinder in a space between the outlet valve and the first valve; and a stationary piston fixedly positioned in the compressor, the stationary piston being fitted in the moving piston so that the fluid in the second compression chamber is compressed as the moving piston is reciprocated, the stationary piston having an inlet flow channel provided therein so that the fluid is introduced through the inlet flow channel; and a second valve provided at the stationary piston such that the second compression chamber is provided between the first valve and the second valve; and a valve-actuating unit that opens and closes the second valve.

8. The compressor as set forth in claim 7, wherein the second valve comprises a plate valve provided at the front part of the stationary piston, and wherein the valve-actuating unit comprises: an actuator that generates a driving force in response to an external signal; and a push rod that connects the actuator and the plate valve, the pushrod moving the plate valve in response to the operation of the actuator.

9. A linear compressor comprising:

a first cylinder;

a linear motor comprising a stator and a magnet configured to generate a linear driving force;

an outlet valve positioned at a front part of the first cylinder;

a first piston connected to the magnet of the linear motor, the first piston being movable forward and backward in the first cylinder, the first piston having a first flow channel provided therein, the first flow channel communicating with the interior of a first cylinder;

a first inlet valve disposed at a front part of the first piston, the first inlet valve configured for opening and closing the first flow channel;

a second cylinder connected to a rear part of the first piston so that the second cylinder is moved together with the first piston, the second cylinder having a second flow channel provided therein, the second flow channel communicating with the first flow channel;

a back cover disposed in the compressor, the back cover having an inlet port provided therein;

a second piston fixedly attached to the back cover, the second piston being fitted in the second cylinder such that fluid in the first and second flow channels is compressed as the first piston and the second cylinder are reciprocated, the second piston having a third flow channel provided therein, the inlet port of the back cover being connected to the second flow channel via the third flow channel; and a second inlet valve disposed at a front part of the second piston, the second inlet valve configured for opening and closing the third flow channel;

wherein the stationary piston is spaced from a rear end of the stationary cylinder in an axial direction of the stationary cylinder, wherein the moving piston comprises:

a piston part that is linearly movable, a portion of the piston part extending into the stationary cylinder; and a moving cylinder part connected to a rear of the piston part, the stationary piston being positioned within the moving cylinder.

10. The compressor as set forth in claim 9, wherein the first piston is provided at a rear part thereof with a flange, the flange being fixed to a movable member of the linear motor, and wherein the second cylinder is fixedly attached to a rear part of the flange.

11. The compressor as set forth in claim 9, wherein the first inlet valve is opened when the first piston is moved backward toward the second piston.

12. The compressor as set forth in claim 9, wherein the second inlet valve is opened when the first piston and the second cylinder are moved forward toward the first cylinder.

13. The compressor as set forth in claim 9, wherein the first and second inlet valves comprise plate valves.

14. The compressor as set forth in claim 9, further comprising a valve-actuating unit that opens and closes the second inlet valve.

15. The compressor as set forth in claim 14, wherein the second inlet valve comprises a plate valve, and wherein the valve-actuating unit comprises: an actuator that generates a driving force in response to an external signal; and a push rod that connects the actuator and the plate valve, the pushrod moving the valve in response to the operation of the actuator.

16. A linear compressor comprising:

a linear motor comprising a stator and a magnet and configured to generate a liner driving force;

a stationary cylinder having a first compression chamber formed therein an outlet valve provided at a front part of the stationary cylinder;

a moving piston movable forward and backward along with the linear motor, the magnet of the linear motor being connected to the moving piston such that fluid in the first compression chamber of the stationary cylinder is compressed, the moving piston having a second compression chamber provided therein, the second compression chamber communicating with the first compression chamber; and a stationary piston movable into the second compression chamber for compressing fluid in the second compression chamber as the moving piston is moved forward and backward;

wherein the stationary piston is spaced from a rear end of the stationary cylinder in an axial direction of the stationary cylinder, wherein the moving piston comprises:

a piston part that is linearly movable, a portion of the piston part extending into the stationary cylinder; and a moving cylinder part connected to a rear of the piston part, the stationary piston being positioned within the moving cylinder.

17. The compressor as set forth in claim 16, wherein the moving piston is provided, at the position where the second compression chamber communicates with the first compression chamber, with a first valve.

18. The compressor as set forth in claim 16, wherein the stationary piston has an inlet flow channel provided therein, and the stationary piston is provided, at the position where the inlet flow channel communicates with the second compression chamber, with a second valve.

19. The compressor as set forth in claim 18, further comprising a valve-actuating unit that opens and closes the second valve.

20. The compressor as set forth in claim 19, wherein the outlet valve comprises:

an inner outlet cover mounted to a cylinder block to communicate with the stationary cylinder and having a fluid outlet formed at one side thereof;

an outer outlet cover disposed outside the inner outlet cover and spaced from the inner outlet cover; and a valve body elastically supported by a spring disposed in the inner outlet cover, that opens and closes the stationary cylinder.

21. An operation process of a linear compressor, comprising:

forwardly moving a moving piston and a moving cylinder toward an outlet valve;

compressing fluid in a first compression chamber comprising a stationary cylinder;

discharging fluid in the first compression chamber through the outlet valve;

introducing fluid from outside of a back cover into a second compression chamber through an inlet port of the back cover and a third flow channel formed in a stationary piston;

backwardly moving the moving piston and the moving cylinder toward the inlet port of the back cover;

compressing the fluid in the second compression chamber;

introducing the compressed fluid in the second compression chamber into the first fluid compression chamber; and positioning the stationary piston at a location spaced from a rear end of the stationary cylinder, in an axial direction of the stationary cylinder.

22. The operation process of a linear compressor as set forth in claim 21, the operation process further comprising:

closing a part of a first valve corresponding to a first flow channel formed in the moving piston;

opening a part of a second valve corresponding to the third flow channel;

closing a part of the second valve corresponding to the third flow channel; and opening a part of the first valve corresponding to the first flow channel toward the outlet valve.

23. The operation process of a linear compressor as set forth in claim 21, the forwardly moving comprising moving the moving piston forwardly with respect to the stationary cylinder.

* * * * *